US005298695A

United States Patent [19]

Bahjat et al.

[11] Patent Number: 5,298,695

[45] **Date of Patent: * Mar. 29, 1994**

[54] ELEVATOR SYSTEM WITH VARYING MOTION PROFILES AND PARAMETERS BASED ON CROWD RELATED PREDICTIONS

[75] Inventors: Zuhair S. Bahjat, Farmington; Venkataramana S. Pullela, North Granby, both of Conn.

[73] Assignee: Otis Elevator Company, Ten Farm Springs, N.J.

[ * ] Notice: The portion of the term of this patent subsequent to Aug. 31, 2010 has been disclaimed.

[21] Appl. No.: 15,065

[22] Filed: Feb. 8, 1993

Related U.S. Application Data

[63] Continuation of Ser. No. 508,319, Apr. 12, 1990, abandoned.

[51] Int. Cl.[5] ..... B66B 1/28; B66B 1/24

[52] U.S. Cl. ..... 187/118; 187/125; 187/116

[58] Field of Search ..... 187/101, 118, 116, 122, 187/125

[56] References Cited

U.S. PATENT DOCUMENTS 3,891,064 6/1975 Clark ..... 187/118
4,658,935 4/1987 Holland ..... 187/122
5,022,497 6/1991 Thanagavelu ..... 187/124
5,241,141 8/1993 Cominelli ..... 187/116

OTHER PUBLICATIONS

G. C. Barney and S. M. dos Santos "Lift Traffic Analysis Design & Control" pub. by Peter Peregrinus Ltd Southgate House, Stevenage, Herts SG1 1HQ England (1977).

*Primary Examiner*—Steven L. Stephan
*Assistant Examiner*—Robert Nappi

[57] ABSTRACT

An elevator system (FIG. 1) employing a microprocessor-based group controller (FIG. 2) communicating with elevator cars (3, 4, . . . ) to affect the assignment of cars to hall calls at a plurality of floors in the building, using different, speedier car motion profiles and system motion parameters when the presence of a passenger crowd is predicted (FIGS. 3-5). When a large passenger crowd presence is predicted, each of the assigned car(s) going to the relevant floor(s) is given a higher jerk and acceleration and deceleration rates for improved service time and decreased waiting time. (See FIG. 5.) When such a passenger crowd presence is no longer predicted (crowd signal reset), the car reverts back to a profile with a lower jerk and acceleration and deceleration rates for enhanced passenger comfort. The prediction methodology used for the predicted presence of a crowd utilizes "artificial intelligence" logic.

2 Claims, 6 Drawing Sheets

ELEVATOR SYSTEM WITH VARYING MOTION PROFILES AND PARAMETERS BASED ON CROWD RELATED PREDICTIONS

REFERENCE TO RELATED APPLICATIONS

This is a continuation of application Ser. No. 07/508,319, filed Apr. 12, 1990, now abandoned.

This application relates to some of the same subject matter as the copending applications listed below, owned by the assignee hereof, the disclosures of which are incorporated herein by reference:

Ser. No. 07/318,295 of Kandasamy Thangavelu entitled "'Artificial Intelligence' Based Crowd Sensing System For Elevator Car Assignment" filed on Mar. 3, 1989, now U.S. Pat. No. 5,022,497;

Ser. No. 07/487,574 of Kandasamy Thangavelu entitled "'Artificial Intelligence' Based Learning System Predicting 'Peak-Period' Times For Elevator Dispatching" filed on Mar. 2, 1990, now U.S. Pat. No. 5,035,302;

Ser. No. 07/375,429 of Skalski entitled "Elevator Speed Dictation System" filed Jul. 3, 1989 now U.S. Pat. No. 5,035,301, and Ser. No. 07/508,322 of Zuhair S. Bahjat and Gerald B. Fried entitled "Automatic Selection of Different Motion Profile Parameters Based on Average Waiting Time" filed on Apr. 12, 1990.

TECHNICAL FIELD

The present invention relates to elevator systems and to varying the motion profiles of the elevator cars and motion parameters of the system based on the presence or absence of predicted crowd conditions using "artificial intelligence" logic based predictions.

BACKGROUND ART

Motion Profile and System Motion Parameters

In general, the need to control the velocity of an elevator is well known. Reference is had, for example, to assignee's U.S. Pat. No. 4,751,984 of Walter L. Williams, Donald G. McPherson and Arnold Mendelsohn entitled "Dynamically Generated Adaptive Elevator Velocity Profile" issued Jun. 21, 1988, as well as to the art cited therein, the disclosure of which are incorporated herein by reference.

As noted in the Williams et al patent, automatic elevator operation involves the control of elevator velocity with respect to zero or stop, at the beginning and the end of a trip, to speeds therebetween, which minimize trip time while maintaining comfort levels and other constraints. The time change in velocity for a complete trip is termed the car's "velocity" or "motion profile." Automatic elevator control further requires control of the distance travelled during a trip in order to accomplish a precision stop at the destination floor. See also the said '401 patent.

Thus, in an elevator system a car is typically moved from one location to another with an acceptable motion profile and system motion parameters which involve acceptable car "jerk" and acceleration. The particular motion profile and motion parameters selected represent a compromise between the desire for "maximum" speed and, inter alia, the need to maintain acceptable levels of comfort for the passengers.

Maximum speed, of course, allows the car to get from floor location to floor location in as short a time as possible, so as to minimize the service time and the waiting time of passengers and improve handling capacity. Maximum speed thus achieves the best service possible, but then this must be tempered with the need for acceptable limits of passenger comfort. Thus, for example, with respect to the latter constraint, too great a rate of acceleration or deceleration produce unacceptable passenger discomfort.

In view of the necessity of this compromise between minimizing service time and the need for passenger comfort, an acceptable motion profile governing the movement of each elevator car as it moved from one location to another was included in the design of an elevator system and remained fixed during the operation of the system. Such acceptable profile varies from marketing territory to marketing territory (e.g. the North American market generally places greater emphasis on speed, while the Pacific market places greater emphasis on comfort) or indeed from customer to customer, but once set in the system the profile remains fixed during the normal operation of the system.

Thus, regardless of which motion profile was ultimately decided upon, it was typically pre-selected and fixed prior to starting the operation of the system. These fixed motion profile parameters provided a certain level of performance and ride quality that would stay the same for the rest of the elevator life, unless changed by a mechanic or an adjuster at the job site. If the pre-set parameters favored ride quality, then the relatively low acceleration, jerk and deceleration rates of the profile diminished performance, and vice-versa. The system therefore suffered in one way or another from this compromise on a relatively fixed or "permanent" basis.

Traffic Prediction Methodology

A number of passenger prediction or estimating techniques have been suggested for use in elevator systems.

In particular, the "crowd" prediction techniques used as one aspect of the present invention are as disclosed and claimed in said '497 patent and involve the accurate prediction or forecasting of "crowd" type traffic demands based on boarding counts and deboarding counts and car stop counts using single exponential smoothing and/or linear exponential smoothing.

It is also noted that some of the general prediction or forecasting techniques of the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

DISCLOSURE OF INVENTION

The present invention originated from the need to improve elevator service time consistent with acceptable limits of car passenger comfort. It achieves this goal within this constraint in the following manner.

Varying Car Motion Profiles and System Motion Parameters

The present invention changes the selected motion profile during system operation to a more performance oriented profile when the presence of a crowd is predicted to be present and a more comfortable profile when no crowd presence is predicted, in essence attaining "the best of both worlds" when each of their respective aspects is more important and significant.

In order to achieve the shortest time to serve a passenger crowd, particularly a large crowd, when a car's speed can be most effective in providing building service, the invention uses a motion profile with a higher jerk and acceleration parameters for cars assigned to handle a predicted crowd. Thereafter, when the absence of a crowd is predicted for such a car, the motion profile and motion parameters are returned to normal for enhanced passenger comfort. Thus, the car reverts back to a profile with a lower jerk and acceleration parameters, when the crowd signal is reset, i.e., when no crowd presence is predicted.

The change to an enhanced or stronger motion profile is preferably only done for the situation when the car is to go to a floor and not for when leaving the floor presumably with a crowd, as the former will reduce the awaiting passenger(s) waiting time and the latter would subject the predicted crowd to some discomfort; the car is then less full or empty, thus avoiding any unnecessary passenger discomfort.

The approach of the invention thereby provides better service for large crowds at floor(s) for the period of time in question than would otherwise have been achieved by cars with a lower, unvaried, motion profile.

"Artificial Intelligence" Prediction Methodology

Part of the strategy of the present invention is the accurate prediction or forecasting of traffic dynamics in the form of "crowds" using preferably single exponential smoothing and/or linear exponential smoothing and numerical integration techniques in making the predictions. In this aspect of the invention the traffic levels at various floors are predicted by collecting the passengers and car stop counts in real time and using real time, as well as historic prediction if available, for the traffic levels, in similar fashion to the approaches described in said '497 patent.

A "crowd" within the context of the present invention represents a relatively large number of passengers, for example, of the order of about twelve or more awaiting passengers going in a particular direction. Of course a number less than twelve could be used, depending on a number of factors, including the number of cars, number of floors, etc. As a practical matter, a "crowd" should be considered to be no less than at least three passengers and more typically eight, ten or twelve or more passengers.

The definition of a "crowd" can be based on a car's capacity. Alternatively, for further example, the definition of a "crowd" could be independent of the number of or the capacity of a car, and instead be based on a certain percentage of the building population or a certain percentage of the floor's population, thus varying from building-to-building and from floor-to-floor, respectively. An example of a percentage of floor population for an exemplary business building would be twelve percent, with the floor population being, for example, one hundred people.

The predicted passenger arrival counts are used to predict the crowd at relatively short intervals, for example, every fifteen seconds, or other appropriate programmable interval period, at the floors where significant traffic is predicted. The crowd prediction is then adjusted for the hall call stops made and the numbers of passengers picked up by the cars.

The crowd direction is derived from the traffic direction. The crowd dynamics are matched to car assignment so that one, two, or more than two cars can be sent to the crowded floor if desired, as in said '497 patent. When they are sent, a higher or speedier motion profile is used for the travel of the car(s) to the "crowd" predicted floor(s).

By these techniques, more efficient service is provided by the algorithms used in the preferred exemplary embodiment of the present invention, when crowds are present at one or more floors.

The present invention thus controls motion profiles of the elevator cars to be dispatched based on dispatcher algorithms using "artificial intelligence" ("AI") techniques based on historic and real time traffic predictions to predict the presence of "crowd(s)" at various floors, and using this information to better service the crowded floor(s).

For example, when significant passenger boarding rates are observed at any floor in any direction, the crowd size is computed at that floor in that direction. The crowd size is computed by summing up the average passenger arrival rate for, for example, each fifteen seconds, or other appropriate programmable interval period. So for all such floors and direction the crowd count will be predicted and stored at the exemplary fifteen second intervals.

If the computed crowd size exceeds a pre-set "crowd limit," for example, twelve passengers, a crowd signal is generated. When a crowd signal is present, if a hall call also has been registered, the motion profile of the car(s) assigned to the calls is/are changed to a higher profile, that is, one with greater acceleration deceleration and jerk in order to minimize the travel time to answer the call for the predicted crowd. When the crowd signal is reset, namely, a crowd presence is no longer being predicted, the cars assigned to hall calls are returned to their normal motion profile, enhancing passenger comfort.

Thus, the crowd sensing features of the present invention use "artificial intelligence" based traffic predictions and do not require separate, hardware sensors to monitor the floors for the presence of crowds. However, if sensors are available, the signals from the sensors, indicating whether a crowd is or is not present, could be used in an analogous fashion to the signals based on the AI predictions of the presence or absence of a crowd.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BRIEF DESCRIPTION OF DRAWINGS

FIG. 1 is a simplified illustration, partially cut away, of an exemplary elevator system in which the present invention may be incorporated in connection with the group controller and the individual elevator car controllers; while

BEST MODE FOR CARRYING OUT THE INVENTION

Figure 1:
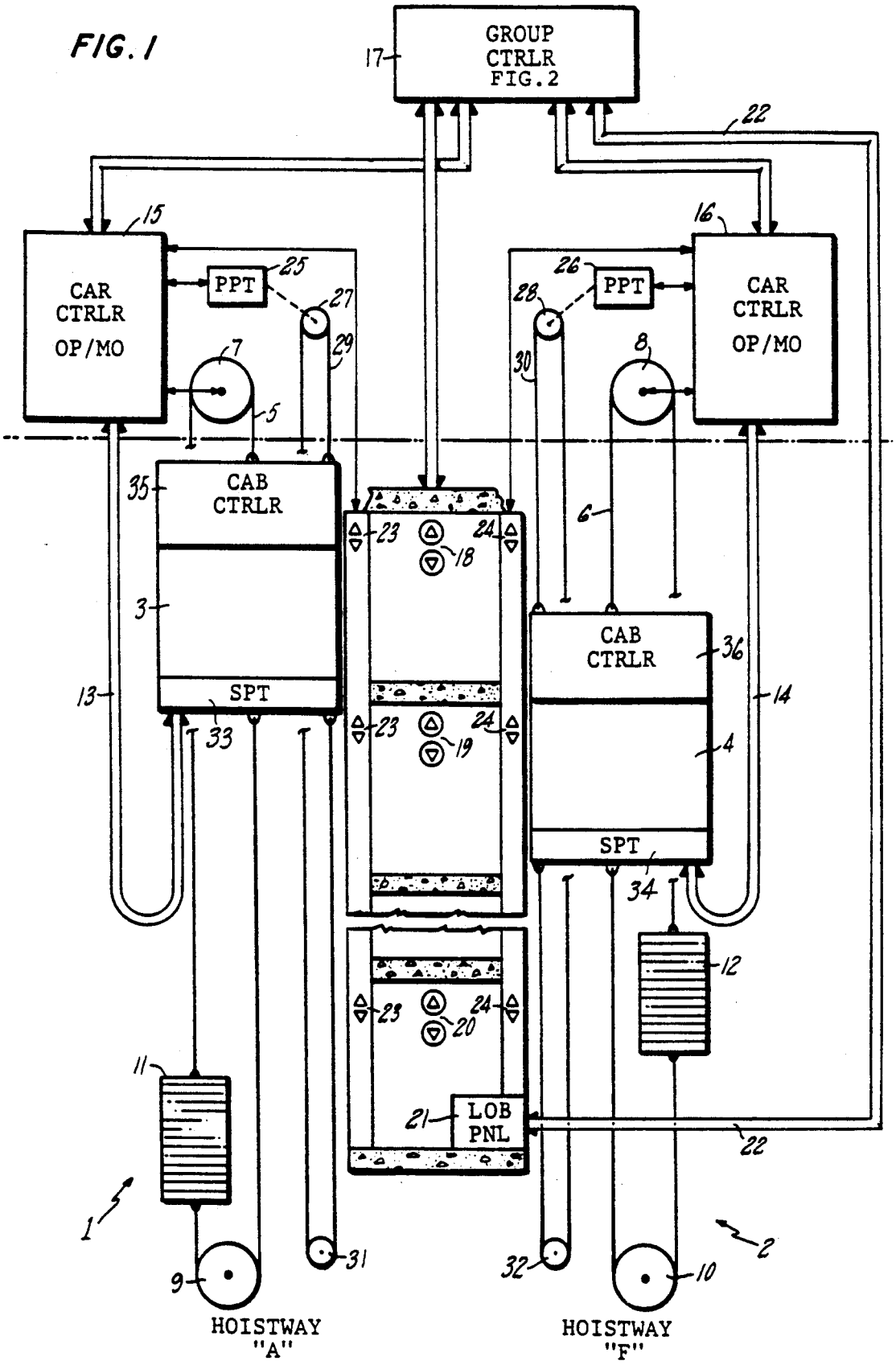

Exemplary Elevator Application (FIG. 1)

For the purposes of detailing an exemplary application for the present invention, the disclosures of U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. Pat. No. 5,024,295 of Kandasamy Thangavelu entitled "Relative System Response Elevator Dispatcher System Using 'Artificial Intelligence' to Vary Bonuses and Penalties," as well as of the commonly owned U.S. Pat. No. 4,330,836 entitled "Elevator Cab Load Measuring System" of Donofrio & Games issued May 18, 1982, are incorporated herein by reference.

Figure 2:
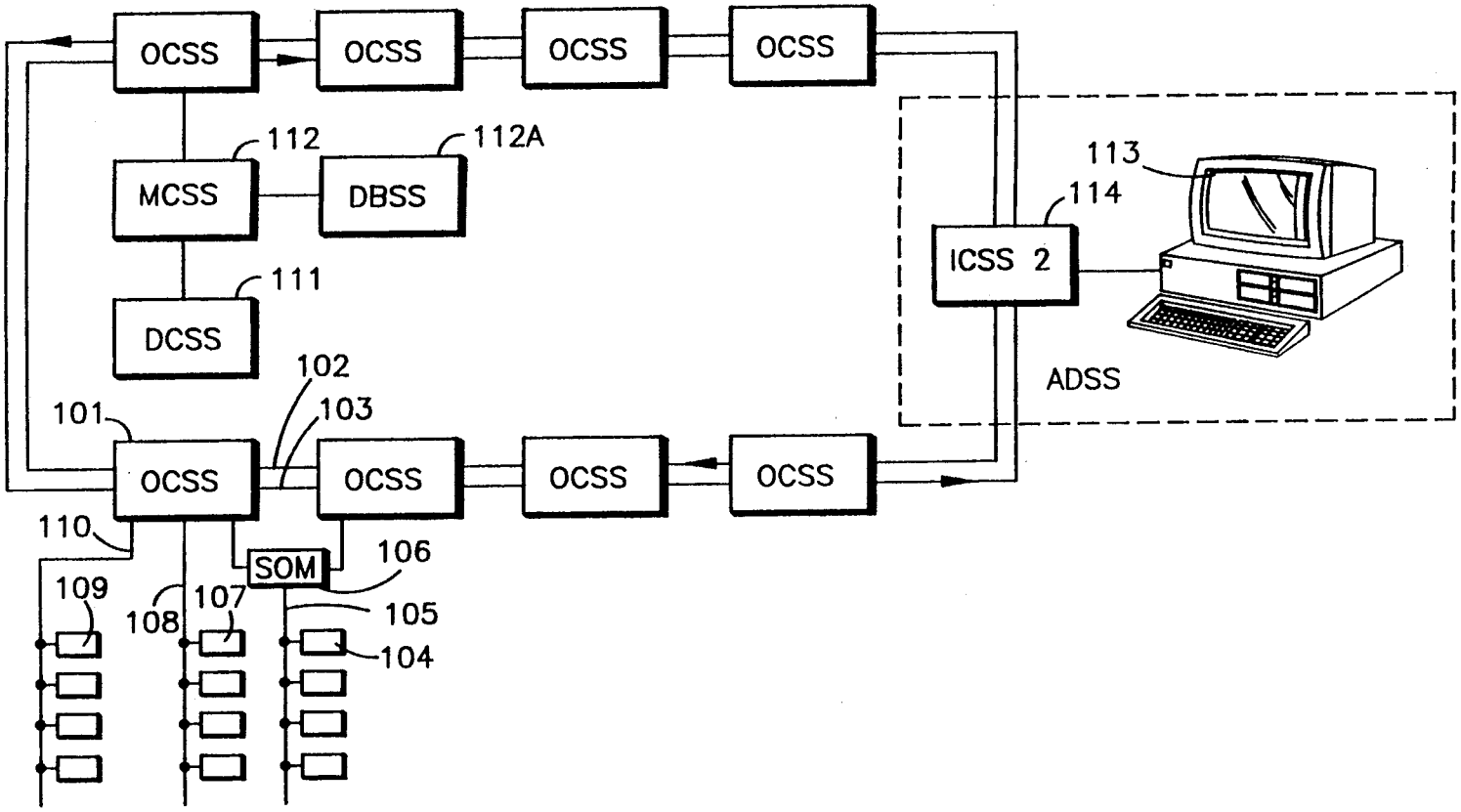
FIG. 2 is a simplified, schematic block diagram of an alternate, exemplary ring communication system for elevator group control, which may be employed in connection with the elevator car elements of the system of FIG. 1, and in which the invention may be implemented in connection with the advanced dispatcher subsystem (ADSS) and the cars' individual operational control subsystems (OCSS) and their related subsystems.

The preferred application for the present invention is in an elevator control system employing microprocessor-based group and car controllers using signal processing means, which through generated signals communicates with the cars of the elevators system to determine the conditions of the cars and responds to hall calls registered at a plurality of landings in the building serviced by the cars under the control of the group and car controllers, to provide assignments of the hall calls to the cars. An exemplary elevator system with an exemplary group controller and associated car controllers (in block diagram form) are illustrated in FIGS. 1 and 2, respectively, of the '381 patent and described in detail therein.

It is noted that FIG. 1 hereof is substantively identical to FIG. 1 of the '381 and '568 patents. For the sake of brevity the elements of FIG. 1 are merely outlined or generally described below, while any further, desired operational detail can be obtained from the '381 and the '568 patents, as well as others of assignee's prior patents. Additionally, for further example, the invention could be implemented in connection with the advanced dispatcher subsystem (ADSS) and the operational control subsystems (OCSSs) and their related subsystems of the ring communication system of FIG. 2.

In FIG. 1 a plurality of exemplary hoistways, HOISTWAY "A" 1 and HOISTWAY "F" 2 are illustrated, the remainder not being shown for simplicity purposes. In each hoistway an elevator car or cab 3, 4 (etc.) is guided for vertical movement on rails (not shown). Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18-20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller 17 in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone and outer door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 in accordance with the present invention, and may provide serial, time-multiplexed communications with the car controller 15, 16, as well as direct, hard-wired communications with the car controller by means of the traveling cables 13 and 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefor, under conditions which are determined to be safe.

The makeup of micro-computer systems, such as may be used in the implementation of the car controllers 15, 16, the group controller 17, and the cab controllers 35, 36, can be selected from readily available components or families thereof, in accordance with known technology as described in various commercial and technical publications. The micro-computer for the group controller 17 typically will have appropriate input and output (I/O) channels, an appropriate address, data and control buss and sufficient random access memory (RAM) and appropriate read-only memory (ROM), as well as other associated circuitry, as is well known to those of skill in the art. The software structures for implementing the present invention and the peripheral features which are disclosed herein, may be organized in a wide variety of fashions.

Exemplary Ring System (FIG. 2)

As a variant to the group controller elements of the system of FIG. 1, in certain elevator systems, as described in U.S. Pat. No. 5,202,540, entitled "Two-Way Ring Communication System for Elevator Group Control" Patented Apr. 13, 1993, the disclosure of which is incorporated herein by reference, the elevator group control may be distributed to separate microprocessors, one per car. These microprocessors, known as operational control subsystems (OCSS) 101, are all connected together in a two-way ring communication (102, 103). Each OCSS 101 has a number of other subsystems and signaling devices, etc., associated with it, as will be described more fully below, but only one such collection of subsystems and signaling devices is illustrated in FIG. 2 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. The load in turn is sent to the OCSS 101. DCSS 111 and MCSS 112 are micro-processors controlling door operation and car motion under the control of the OCSS 101, with the MCSS 112 working in conjunction with the drive and brake subsystem (DBSS) 112A.

The dispatching function is executed by the OCSS 101, under the control of the advanced dispatcher subsystem (ADSS) 113, which communicates with the OCSS 101 via the information control subsystem (ICSS) 114. The car load measured may be converted into boarding and deboarding passenger counts by the MCSS 112 and sent to the OCSS 101. The OCSS sends this data to the ADSS 113 via ICSS 114.

The ADSS 113 through signal processing collects the passenger boarding and deboarding counts at the various floors and car arrival and departure counts, so that, in accordance with its programming, it can predict, for example, traffic conditions at each floor for predicting the start and end of the presence of a predicted crowd, as described below. Depending on the presence or absence of a crowd signal from a car's OCSS 101 based on these predictions, the appropriate motion profile is selected from a stored table of data in MCSS 112 and used to govern the car's movement under the control of the DBSS 112A, all also as described more fully below. The stored table can either be static, once set in the system and so maintained, or, if so desired, the table can be dynamically computed and changed during system operation based on "learning" or "on-the-fly" technology.

The ADSS 113 can also collect inter alia other data for use in making other predictions for other uses, if so desired.

For further background information reference is also had to the magazine article entitled "Intelligent Elevator Dispatching Systems" of Nader Kameli & Kandasamy Thangavelu (*AI Expert*, September 1989; pp. 32–37), the disclosure of which is also incorporated herein by reference.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicates for each car the car's load.

Using such data and correlating it with the time of day and the day of the week, a meaningful traffic measure can be obtained for determining start and end of the presence of passenger crowd(s), in accordance with the "crowd" prediction aspect of the invention by using signal processing routines that implement the sequences described in the flow charts of FIGS. 3–5, described more fully below.

Exemplary AI Prediction Methodology Used In the Invention

As will be detailed below, the exemplary embodiment of the invention originated from the need to improve dispatcher service by correctly identifying the presence of a crowd and, when a crowd presence is indicated, changing the motion profile of the assigned car(s) to a heavier or speedier profile, effectively speeding up the car to serve the hall call in less time when a large number of people (a "crowd") is predicted to be present.

Exemplary "AI" Based Crowd Sensing System

The "AI" principles used as an aspect of the invention and the application of this aspect of the invention in a detailed exemplary embodiment will be discussed first, and then the exemplary embodiment will be further discussed in association with the drawings.

Between, for example, 6:00 AM and midnight, that is for the whole active work day, at each stop (each stop being at a particular floor for travel in a selected direction), the following traffic data is collected for short periods of time, for example, each one minute interval, in terms of the:

number of hall call stops made, number of passengers boarding the cars using car load measurements at the floors, number of car call stops made, and number of passengers deboarding the cars, again using car load measurements at the floors, At the end of each interval, the data collected during, for example, the past three intervals at various floors in terms of passenger counts and car stop counts are analyzed. If the data shows that car stops were made at any stop (any floor in any direction) in, for example, two out of the three past minutes and on the average more than, for example, two passengers boarded or two passengers deboarded each car at that floor and direction, during at least two intervals, the real time prediction for that floor and direction is initiated. Alternatively, as indicated above, the presence of significant traffic or a "crowd" could be based on some percentage figure of building population or floor population, rather than the specific numbers here indicated.

The traffic for the next few two or three minute intervals for that floor, direction and traffic type (boarding or deboarding) is then predicted, using preferably a linear exponential smoothing model. Both passenger counts and car stop counts (hall call stops or car call stops) are thus predicted.

Large traffic volume may be caused by normal traffic patterns occurring on each working day of the week or due to special events occurring on the specific day.

The real time prediction is terminated when the total number of cars stopping at the floor in that direction and for that traffic type is less than, for example, two for four consecutive intervals and the average number of passengers boarding the cars or deboarding the cars during each of those intervals is less than, for example, two. Alternatively, as indicated above, the presence of significant traffic or a "crowd" could be based on some percentage figure of building population or floor population, rather than the specific numbers here indicated.

Whenever significant traffic levels have been observed at a floor in a direction and real time traffic predictions made, the real time collected data for various intervals is saved in the historic data base, when the real time prediction is terminated. The floor where the traffic was observed, the traffic direction and type of traffic in terms of boarding or deboarding counts and hall call stops or car call stops are recorded in the historic data base. The starting and ending times of the traffic and the day of the week are also recorded in the historic data base.

Once a day, at midnight, the data saved during the day in the historic data base is compared against the data from the previous days. If the same traffic cycle repeats each working day within, for example, a three minute tolerance of starting and ending times and, for example, a fifteen percent tolerance in traffic volume variation during the first four and last four short intervals, the current day's data is saved in the normal traffic patterns file.

If the data does not repeat on each working day, but if the pattern repeats on each same day of the week within, for example, a three minute tolerance of starting and ending times and, for example, a fifteen percent tolerance in traffic volume variation during the first four and last four intervals, the current day's data is saved in the normal weekly patterns file.

After the data collected during the day are thus analyzed and saved in the normal patterns file and normal weekly patterns file, all the data in those files for various floors, directions, traffic types are used to predict traffic for the next day. For each floor, direction and traffic type, the various occurrences of historic patterns are identified one by one. For each such occurrence, the traffic for the next day is predicted using the data at the previous occurrence and the predicted data at the last occurrence and using the exponential smoothing model. All normal traffic patterns and normal weekly traffic patterns expected to be occurring on the next day are thus predicted and saved in the current days historic prediction data base.

At the end of each data collection interval, the floors and directions where significant traffic has been observed, are identified. After the real time traffic for the significant traffic type has been predicted, the current day's historic prediction data base is checked to identify if historic traffic prediction has been made at this floor and direction for the same traffic type for the next interval.

If so, then the two predicted values are combined to obtain optimal predictions. These predictions will give equal weight to historic and real time predictions and hence will use a weighing factor of one-half for both. If however, once the traffic cycle has started, the real time predictions differ from the historic prediction by more than, for example, twenty (20%) percent in, for example, four out of six one minute intervals, the real time prediction will be given a weight of, for example, three-quarters and the historic prediction a weight of one-quarter, to arrive at a combined optimal prediction.

The real time predictions shall be made for passenger boarding or deboarding counts and car hall call or car call stop counts for up to three or four minutes from the end of the current interval. The historic prediction data for up to three or four minutes will be obtained from the previously generated data base. So the combined predictions for passenger counts and car counts can also be made for up to three to four minutes from the end of the current interval.

If no historic predictions have been made at that floor for the same direction and traffic type for the next few intervals, the real time predicted passenger counts and car counts for the next three or four minutes are used as the optimal predictions.

Using this predicted data, the passenger boarding rate and deboarding rate at the floor where significant traffic occurs are then calculated. The boarding rate is calculated as the ratio of total number of passengers boarding the cars at that floor in that direction during that interval to the number of hall call stops made at that floor in that direction during the same interval. The deboarding rate is calculated as the ratio of number of passengers deboarding the cars at that floor, in that direction in that interval to the number of car call stops made at that floor in that direction in the same interval.

The boarding rate and deboarding rate for the next three to four minutes for the floors and directions where significant traffic is observed are thus calculated once a minute. If the traffic at a floor and a direction is not significant, i.e. less than, for example, two persons board the car or deboard the car on the average, the boarding or deboarding rates are not calculated.

Figure 3A:
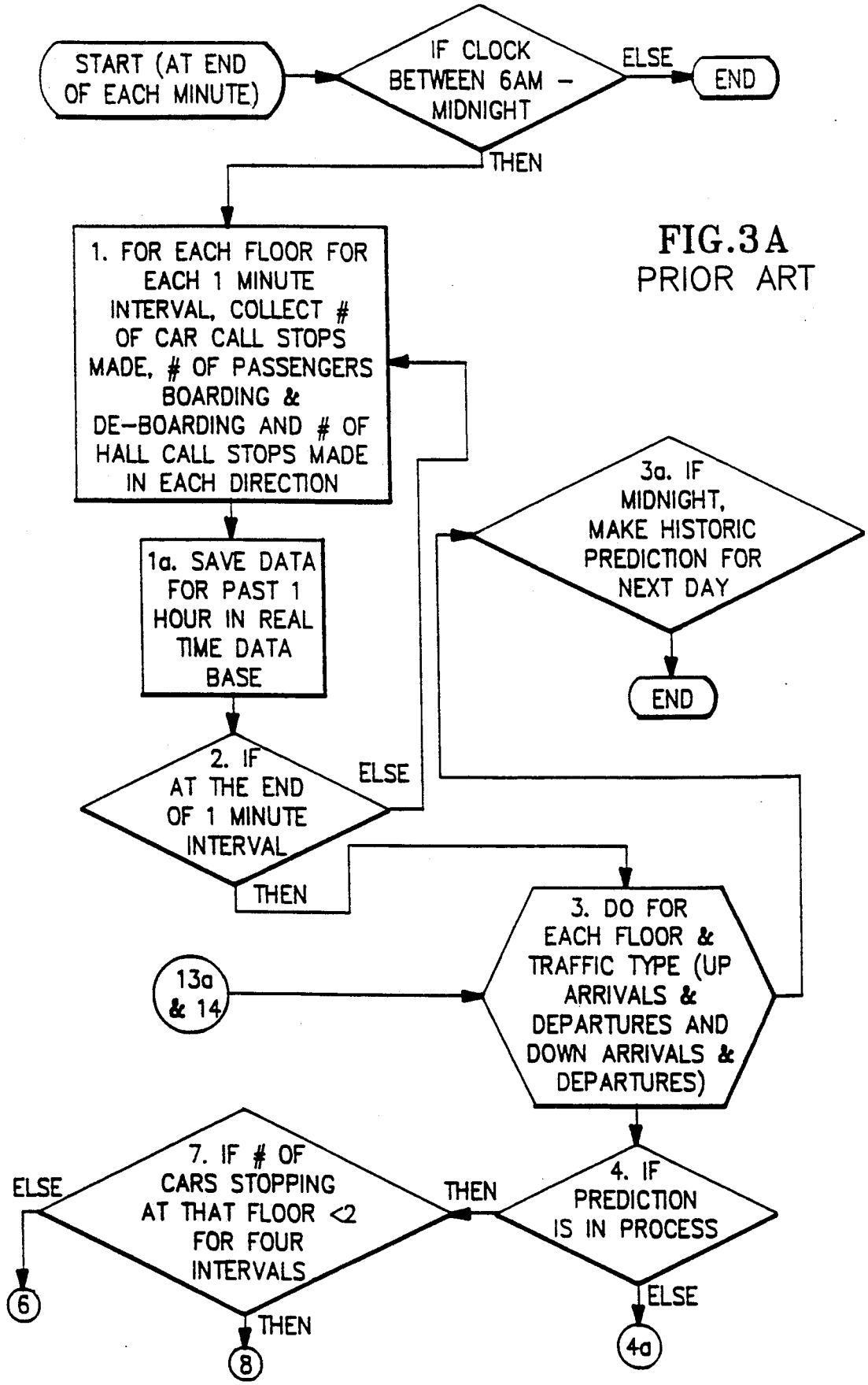
FIG.3A PRIOR ART
FIGS. 3A & 3B, in combination, provide a simplified, logic flow diagram for the exemplary algorithm for the methodology used to collect and predict traffic and passenger boarding and de-boarding rates at various floors in the preferred embodiment of the present invention.
Figure 3B:
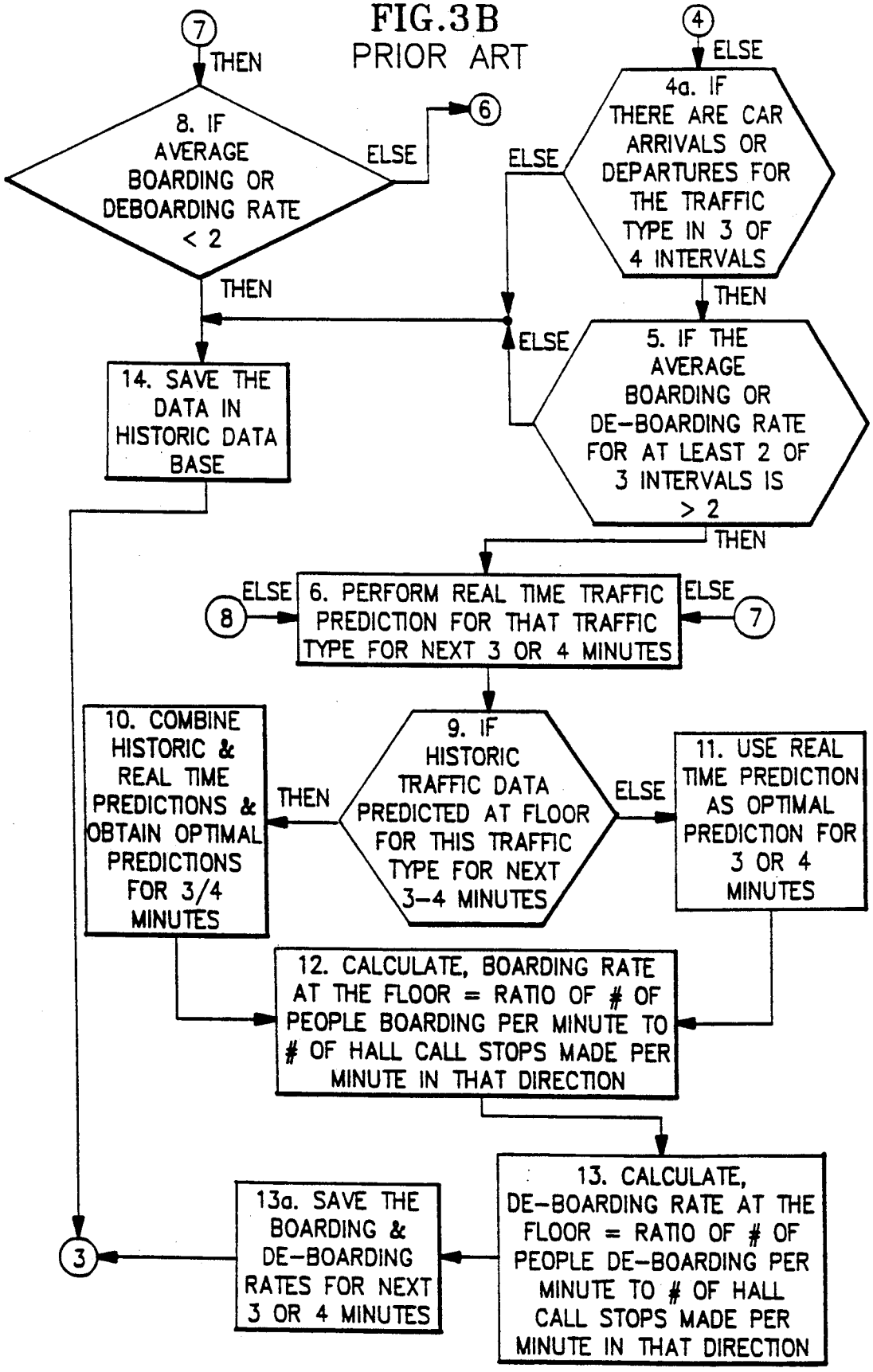
FIG.3B PRIOR ART

FIGS. 3A and 3B

As a particular example of the foregoing, used as the exemplary embodiment of the present invention, the logic block diagram of combined FIGS. 3A and 3B illustrates the exemplary methodology to collect and predict traffic and compute boarding and de-boarding rates. In steps 3-1 and 3-2 the traffic data is collected for, for example, each one minute interval during an appropriate time frame covering at least all of the active work day, for example, from 6:00 AM until midnight, in terms of the number of passengers boarding the car, the number of hall call stops made, the number of passengers deboarding the car, and the number of car call stops made at each floor in the "up" and "down" directions. The data collected for, for example, the latest one hour is saved in the data base, as generally shown in FIGS. 4A and 4B and step 3-1.

In steps 3-3 to 3-4*a* at the end of each minute the data is analyzed to identify if car stops were made at any floor in the "up" and "down" direction in, for example, two out of three one minute intervals and, if on the average more than, for example, two passengers deboarded or boarded each car during those intervals. If so, significant traffic is considered to be indicated.

The traffic for, for example, the next three to four minutes is then predicted in step 3-6 at that floor for that direction using real time data and a linear exponential smoothing model, as generally described in the Makridakis & Wheelwright text cited above, particularly Section 3.6, and, as applied to elevator dispatching, in the specification of the parent application cited above. Thus, if the traffic "today" varies significantly from the previous days' traffic, this variation is immediately used in the predictions.

If this traffic pattern repeats each day or each same day of the week at this floor, the data would have been stored in the historic data base and the data for each two or three minute intervals predicted the previous night for this day, using, for example, the method of moving averages or, more preferably, a single exponential smoothing model, which model is likewise generally described in the text of Makridakis & Wheelwright cited above, particularly Section 3.3, and, as applied to elevator dispatching, in the specification of the parent application cited above.

If such prediction is available, the historic and real time predictions are combined to obtain optimal predictions in step 3-10. The predictions can combine both the real time predictions and the historic predictions in accordance with the following relationship:

$$X = ax_h + bx_r$$

where "X" is the combined prediction, "$x_h$" is the historic prediction and "$x_r$" is the real time prediction for the short time period for the floor, and "a" and "b" are multiplying factors.

Initially, "a" and "b" values of one-half are used. If real time predictions differ from historic predictions by more than, for example, twenty percent for several intervals, the "a" value is reduced and the "b" value is increased, as previously mentioned.

If historic predictions are not available, real time prediction is used for the optimal predictions, as shown in step 3-11.

As can be seen in the figures, other detailed steps or features are included in the algorithm of FIGS. 3A and 3B, but are considered to be self-explanatory in view of the foregoing.

Then, for each floor and direction where significant traffic has been predicted in step 3-12, the average boarding rate is calculated as, for example, the ratio of the predicted number of people boarding the car during the interval to the number of hall call stops made in that interval. The average de-boarding rate is computed in step 3-13 as the ratio of the predicted number of people de-boarding the car during an interval to the number of car call stops made in that interval. These rates are calculated for the next three to four minutes and saved in the data base.

Figure 4

Figure 4:
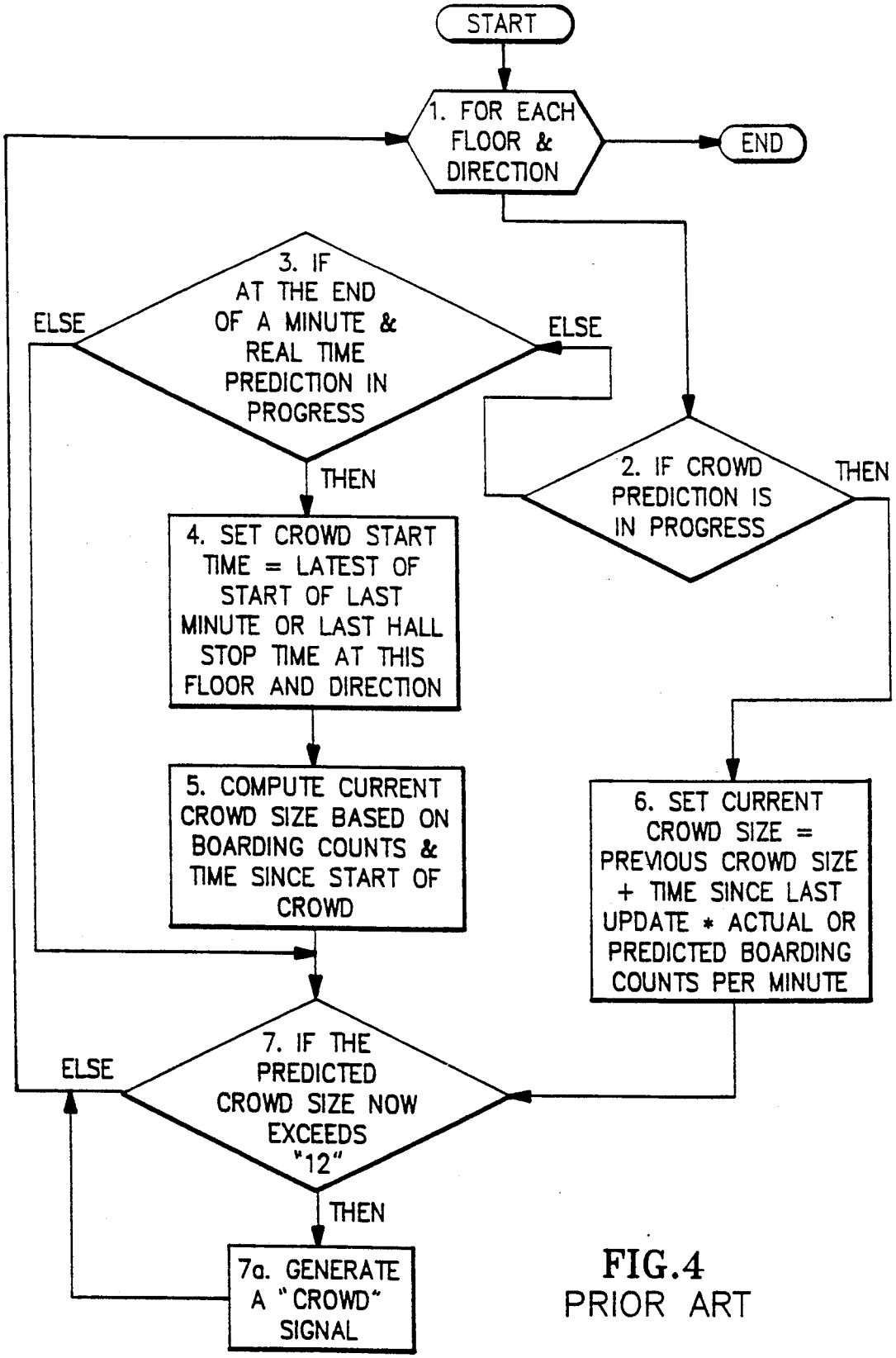
FIG.4 PRIOR ART
FIG. 4 is a simplified, logic flow diagram for the exemplary algorithm for the methodology used to compute crowd size at the floors at the end of fifteen (15) second intervals.

Reference is now had to the logic block diagram of FIG. 4, which illustrates the exemplary methodology to predict any crowd at the end of, for example, each fifteen second interval (or other appropriate programmable interval), used in the exemplary embodiment of the present invention.

The crowd prediction algorithm of FIG. 4 is executed periodically once every fifteen seconds. This algorithm checks each floor and direction and determines if crowd prediction is in progress for that traffic (steps 4-1 and 4-2). If not, in step 4-3, if at the end of a minute and real time traffic prediction has been made for that traffic (so significant traffic has been observed during the past several minutes), then in step 4-4 the crowd start time is set at the latest of the start of the last minute or the last time a car stopped for a hall call at this floor and direction. Then, in step 4-5, using the past minutes' predicted boarding counts, the predicted "crowd" (until the current time) is computed as the product of crowd accumulation time and passenger boarding count per minute.

If in step 4-2 the crowd prediction is in progress, then the last time when a "crowd" was predicted may be fifteen seconds before or may be the last time a car stopped for a hall call at this floor and picked up some people. So in step 4-6 the current crowd size can be computed using the time since the last crowd update and the actual or predicted boarding counts per minute.

In step 4-7, if the predicted crowd size now exceeds, for example, twelve people, a "crowd signal" is generated in step 4-7*a*.

The cars may be assigned to hall calls in assignment cycles at regular intervals of, for example, two hundred and fifty milliseconds. If so, during these assignment cycles, the "up" hall calls are first assigned starting from the one at the lobby and proceeding upwards until the floor below the top most floor. The "down" hall calls are then assigned starting from the top most floor and then proceeding downward, until the floor just above the lobby.

The foregoing details are all as set forth in said '497 patent.

It should be understood that, with respect to historic data, the references above, for example, to the "next day" refer to the "next normal day" and references to the past "several days" refer to the previous several "normal" or work days, all typically involving a working weekday. Thus, for example, weekend days (Saturdays & Sundays) and holidays will not have meaningful or true peak periods and are not included in the peak period strategies of the invention, and their data will not appear in the recorded historic data, unless in fact peak periods do occur on those days.

Figure 5:
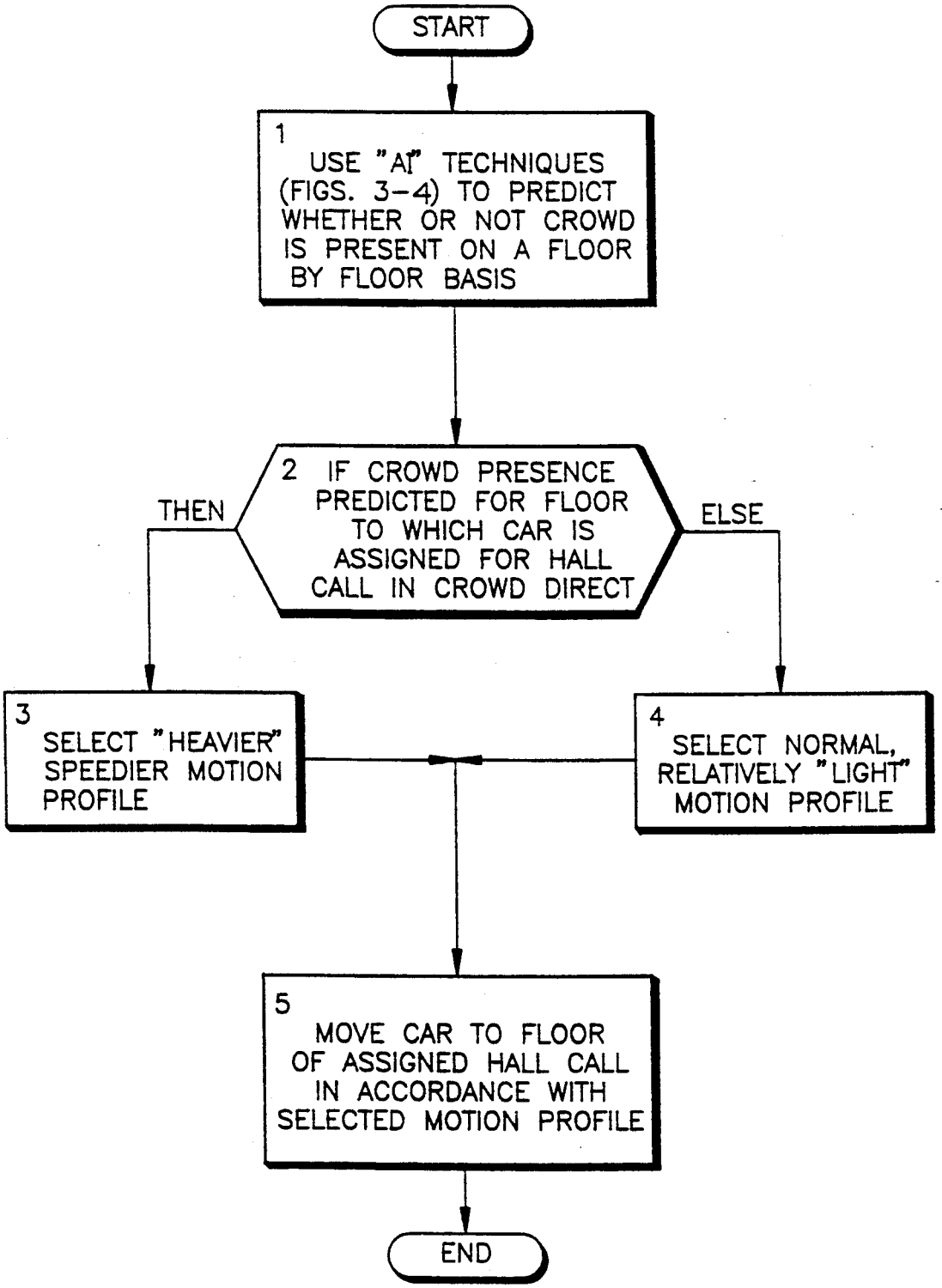
FIG. 5 is a simplified, logic, flow chart diagram for an exemplary, algorithm for the methodology used to vary a car's motion profile and the system's motion parameters when the prediction methodology used in the invention (described with reference to FIGS. 3-4) predicts the start and end of the presence of a passenger crowd and generates a signal accordingly.

Exemplary Algorithm For Varying Motion Profile & Parameters (FIG. 5)

FIG.5 provides in step-by-step format a simplified, logic, flow chart diagram for the exemplary algorithm for the methodology used to vary a car's motion profile and the system's motion parameters when the prediction methodology used in the invention (described with reference to FIGS. 3-4) predicts the presence of a passenger crowd awaiting behind, for example, a hall call. This initial prediction methodology forms step 5-1 of the algorithm of FIG. 5.

In step 5-2, if a "crowd" signal is present (for the floor and direction) at the operational control subsystem OCSS 100, then in step 5-3 a "heavier," speedier motion profile is selected from the car's motion profile data table and sent to the motion control subsystem MCSS 112 as a dicated profile. Typically the data table could be stored in the MCSS with the decision of which set of values or which profile is to be used made in the OCSS.

An exemplary profile data table is presented below.

| Profile | Accelera. Factor (ft./sec$^2$) | Jerk Factor (ft./sec$^3$) | Decelera. Factor (ft./sec$^2$) |
|---|---|---|---|
| Heavy | 8 | 4 | 4 |
| Moderate | 4 | 3 | 3 |
| Light | 2 | 2 | 2 |

For example, with the "crowd" signal set "ON," the relatively "heavy" profile with an acceleration factor of eight feet per second per second (8'/sec.$^2$), a jerk factor of four feet per second per second per second (4'/sec.$^3$) and a deceleration factor of four feet per second per second (4'/sec.$^2$) may be selected.

In contrast, in step 5-4, if a "crowd" signal is not present (crowd signal reset or "OFF") in step 5-2 and there is relatively little traffic, then a "light" (or, alternatively, a "moderate") profile is selected from the car's motion profile data table. For example, the relatively "light" profile with an acceleration factor of two feet per second per second (2'/sec.$^2$), a jerk factor of two feet per second per second per second (2'/sec.$^3$) and a deceleration factor of two feet per second per second (2'/sec.$^2$) may be selected.

Alternatively, particularly where the traffic is neither very light (making the light profile desirable) or intense (making the heavy profile desirable), the "moderate" profile could be selected, if so desired, with an acceleration factor of four feet per second per second (4'/sec.$^2$), a jerk factor of three feet per second per second per second (3'/sec.$^3$) and a deceleration factor of three feet per second per second (3'/sec.$^2$).

Of course, if so desired, an even more sophisticated, relatively complex or fine-tuned profile selection process could be used. Thus, for further example, the greater the size of the predicted crowd, the heavier the selected profile could be.

The stored values in the table typically can be set and later changed (if so desired) on site by field personnel during maintenance.

Alternatively, if so desired, rather than an operationally static set of table values, selected ones of the values could be dynamically computed and up-dated by the ADSS to accommodate, for example, traffic intensity. Additionally, in the exemplary table above, sets of additional profile values could be stored, if so desired.

In step 5-5 the car is moved to the assigned floor under the control of the drive and brake subsystem DBSS 112A in accordance with the factors or parameters contained in the selected, dictated motion profile in MCSS 112.

As noted in the Williams et al and Skalski patents, in order to provide rapid, controlled and smooth motion control in an elevator, a velocity profile is generated which (within system constraints) sets the jerk, acceleration and equipment limitations. Typical, exemplary requirements for a high performance system are:

| | |
|---|---|
| RISE | up to 400 M |
| LOADS | 900 TO 3600 KG |
| SPEEDS | 2.5 to 10 M/S |
| ACCEL. | up to 1.5 M/S$^2$ |
| JERK | up to 3.0 M/S$^3$ |
| LEVELING | ±0.006 M |

The function of the profile generator is to bring the car to the target position within the desired acceleration/deceleration and jerk constraints. These constraints are varied in connection with the algorithm of FIG. 5.

In accordance with the present invention, just before a run, the constraints are changed if a "crowd" signal has been set, indicating the presence of a crowd at the location to which the car is being sent. The profile generator is designed in a structured fashion, thereby permitting adaptation to changing circumstances.

The overall car position control system (MCSS 112 and DBSS 112A) should bring the car to its destination in a minimum amount of time (subject to the set minimum passenger comfort level existing in connection with the sped up profile used when a passenger crowd is predicted in connection with the algorithm of FIG. 5), without vibrations or overshoot. The overall positioning accuracy sought is usually better than plus-or-minus three millimeters (±3 mm), although plus-or-minus six millimeters (±6 mm) may, for example, be considered acceptable.

Although this invention has been shown and described with respect to at least one detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below:

1. An elevator dispatching system which uses selected elevator motion profiles having varied jerk, acceleration and deceleration to selectively provide faster service rather than a more comfortable ride, comprising:

means for measuring and storing information regarding passenger traffic at a predetermined stop during at least a predetermined time interval;

means for determining, based on said historical information, a passenger arrival rate at the predetermined stop for said predetermined time interval;

means for predicting, based on said determined passenger arrival rate, a crowd size at the predetermined stop for said predetermined time interval;

means for comparing said predicted crowd size with a predetermined crowd size threshold;

means for generating a crowd signal when said predicted crowd size exceeds said predetermined crowd size threshold; and means for registering a hall call at said predetermined stop;

wherein the improvement comprises:

means responsive to a registered hall call at said predetermined stop for providing elevator motion control signals to define elevator motion profiles, one of which is a relatively light, normal profile characterized for passenger comfort and one of which is a relatively heavier, speedy profile characterized for elevator speed; and means for dispatching an elevator car to said predetermined stop to answer said hall call using motion control signals defining said normal profile only in the absence of said crowd signal for said predetermined stop and for alternatively dispatching an elevator car to said predetermined stop using motion control signals defining said speedy profile only in the presence of said crowd signal for said predetermined stop.

2. A method of dispatching elevator cars to answer hall calls at stops of a building, comprising:

obtaining historical information of passenger arrival rates at a predetermined stop, said historical information covering at least a predetermined time interval;

determining, based on said historical information, a passenger arrival rate at the predetermined stop for said predetermined time interval;

predicting, based on said determined passenger arrival rate, a crowd size at the predetermined stop for said predetermined time interval;

comparing said predicted crowd size with a predetermined crowd size threshold;

generating a crowd signal when said predicted crowd size exceeds said predetermined crowd size threshold; and assigning an elevator car to respond to a hall call registered for said predetermined stop;

wherein the improvement comprises:

providing elevator motion control signals to define elevator motion profiles, one of which is a relatively light, normal profile characterized for passenger comfort and one of which is a relatively heavier, speedy profile characterized for elevator speed; and dispatching said assigned elevator car to said predetermined stop to answer hall call using motion control signals defining said normal profile only in the absence of said crowd signal for said predetermined stop and for alternatively dispatching said assigned elevator car to said predetermined stop using motion control signals defining said speedy profile only in the presence of said crowd signal for said determined stop.

* * * * *